US005497947A

United States Patent [19]

Potz et al.

[11] Patent Number: 5,497,947

[45] Date of Patent: Mar. 12, 1996

[54] FUEL INJECTION NOZZLE FOR INTERNAL COMBUSTION ENGINES

[75] Inventors: Detlev Potz, Stuttgart; Guenter Lewentz, Hemmingen; Uwe Gordon, Markgroeningen, all of Germany

[73] Assignee: Robert Bosch GmbH, Stuttgart, Germany

[21] Appl. No.: 294,033

[22] Filed: Aug. 24, 1994

[30] Foreign Application Priority Data

Dec. 1, 1993 [DE] Germany ..... 43 40 883.4

[51] Int. Cl.[6] ..... F02M 61/08

[52] U.S. Cl. ..... 239/553.12

[58] Field of Search ..... 239/533.2–533.12, 239/88–92, 563, 453, 456

[56] References Cited

U.S. PATENT DOCUMENTS

| | | | |
|---|---|---|---|
| 1,921,873 | 8/1933 | Gillen | 239/88 |
| 2,035,203 | 3/1936 | Smith | 239/533.12 |
| 2,295,081 | 9/1942 | Harvath | 239/533.7 |
| 2,762,654 | 9/1956 | Purchas, Jr. et al. | 239/90 |
| 3,982,693 | 9/1976 | Hulsing | 239/88 |
| 4,339,080 | 7/1982 | Kopse | 239/533.3 |
| 4,750,675 | 6/1988 | Sczomak | 239/453 |
| 4,905,908 | 3/1990 | Sczomak | 239/533.12 |
| 5,127,584 | 7/1992 | Sczomak | 239/533.11 |

FOREIGN PATENT DOCUMENTS

| | | |
|---|---|---|
| 0209244 | 12/1988 | European Pat. Off. . |
| 2289756 | 5/1976 | France . |

*Primary Examiner*—Karen B. Merritt

*Attorney, Agent, or Firm*—Edwin E. Greigg; Ronald E. Greigg

[57] ABSTRACT

A fuel injection nozzle for internal combustion engines that has a nozzle body with a valve seat disposed on the combustion chamber end and an outwardly-opening valve needle with a closing head, which has a closing cone that works together with the closing valve seat. At least one injection port is disposed in the closing head at an angle with respect to the axis of reciprocation of the valve needle, and is opened by a control edge on the nozzle body depending on the inlet pressure of the fuel. In order to minimize any deflection of the injection stream flowing out of the injection port relative to the alignment of the injection port, the port is divided into at least two parallel conduits, which are separated from each other by a dividing wall and which upon the opening stroke of the valve needle are unblocked one after the other by the control edge.

7 Claims, 2 Drawing Sheets

FIG.2a
PRIOR ART
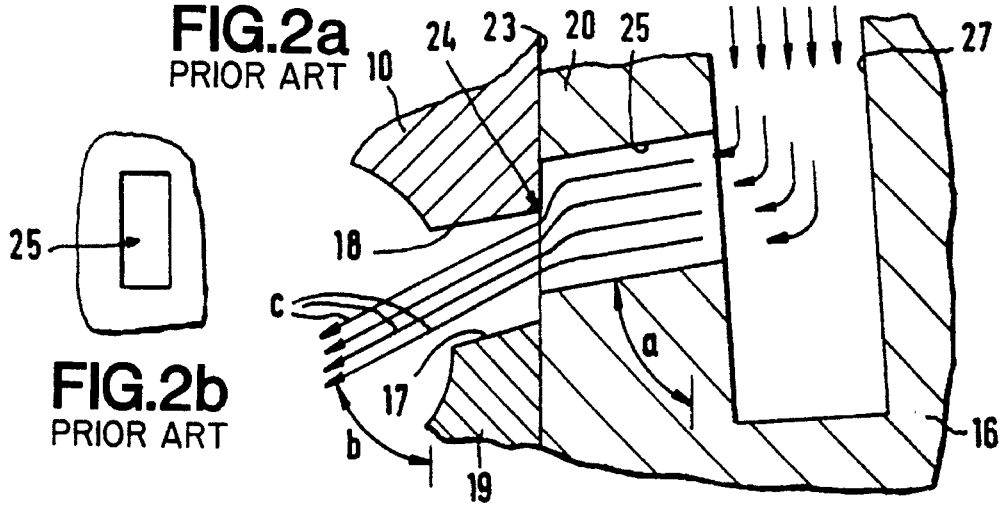
FIG.2b
PRIOR ART
FIG.3a
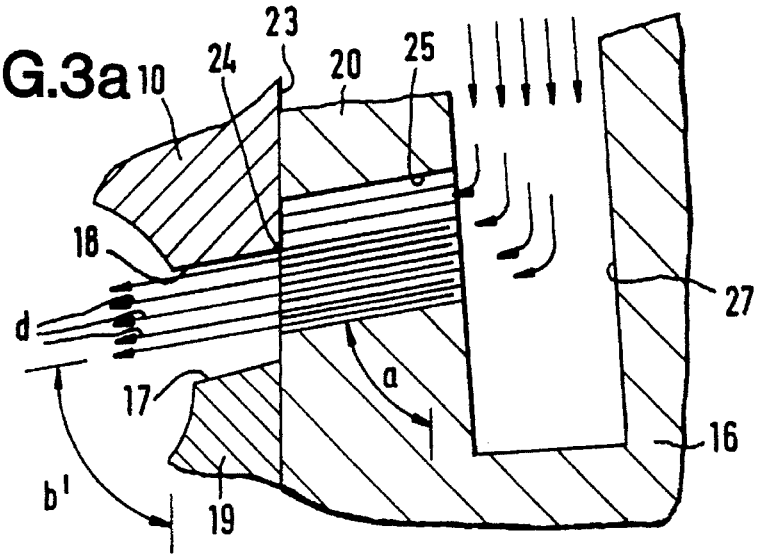
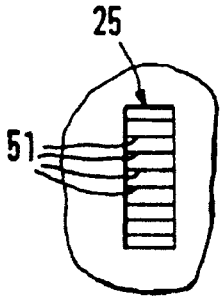
FIG.3b
FIG.4a
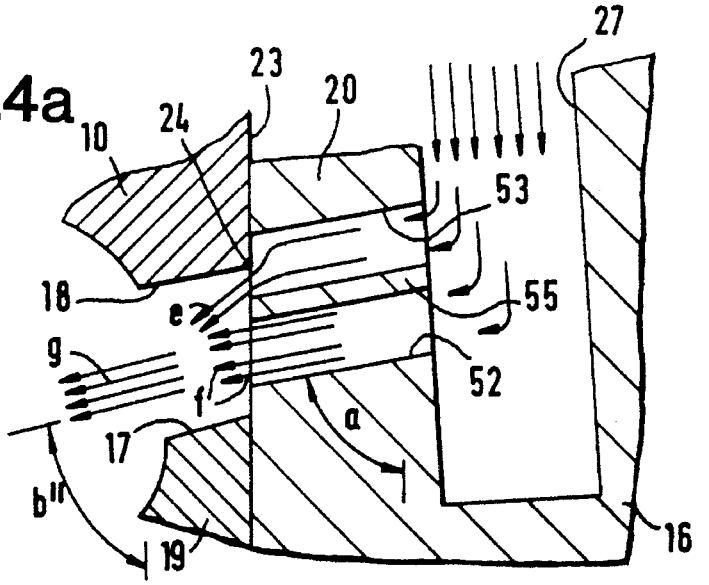
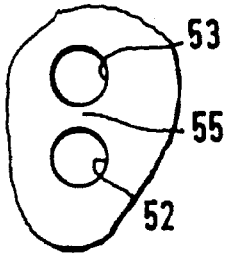
FIG.4b

FUEL INJECTION NOZZLE FOR INTERNAL COMBUSTION ENGINES

BACKGROUND OF THE INVENTION

The invention is based on a fuel injection nozzle for internal combustion engines as defined hereinafter. In a fuel injection nozzle of this kind, known for example from European Patent Disclosure 0 209 244 B1, the discharge point of the injection ports in the valve head, upon the opening stroke, depending upon the inlet pressure of the fuel, are opened by a control edge on the nozzle body so that the injection cross section is adapted to the operating point affiliated with the load and the speed of the engine. In order to achieve such a variable-adjustment effect, the control edge on the nozzle body, which edge narrows the injection stream, sets each required injection cross section. However, this control edge also influences the outlet direction of the injection stream, which is deflected all the more away from the desired direction predetermined by the axial direction of the injection port, the more the discharge point cross section of the injection port is covered over by the control edge. Such deflection of the injection stream or streams away from the injection direction that is ideal for the combustion chamber impairs the preparation of the fuel and hence impairs optimal combustion, making it impossible to meet increasingly stringent exhaust and noise limits.

OBJECT AND SUMMARY OF THE INVENTION

The fuel injection nozzle according to the invention has the advantage that the injection stream generated keeps the flow direction preset by means of the axis of the injection port, so that a good combustion is achieved even at partial load and low engine speeds. Theoretically at each opened injection cross section, the ideal injection direction would be given if the injection port were penetrated by many infinitesimally thin-walled baffles, which were integrated into the injection cross section and were oriented in the direction of its axis. With the available materials for the injection nozzle and with the available working possibilities for manufacturing injection ports having a width of less than 0.2 mm, since the guide partitions must have a set thickness, it is advantageous in forming a guide partition if by means of the removal of material two or more parallel conduits are disposed on top of each other, staggered in the stroke direction and in immediate proximity to one another, separated from one another by means of the remaining guide partitions. The conduits need not be disposed over each other exactly in the direction of the valve member stroke; they can also be staggered slightly at an angle to one another, so that the next conduit is already opened as long as the conduit that was opened up before it is not yet fully open.

The invention will be better understood and further objects and advantages thereof will become more apparent from the ensuing detailed description of a preferred embodiment taken in conjunction with the drawings.

BRIEF DESCRIPTION OF THE DRAWINGS

FIGS. 2*a*, 2*b*, 3*a*, 3*b*, 4*a* and 4*b*, on a greatly enlarged scale, show a section through a detail A of the valve and injection part of the injection nozzle according to FIG. 1;

FIGS. 2*a* and 2*b* show a conventional embodiment;

FIGS. 3*a* and 3*b* show a theoretically ideal embodiment; and

FIGS. 4*a* and 4*b* show an embodiment according to the invention.

DESCRIPTION OF THE PREFERRED EMBODIMENTS

Figure 1:
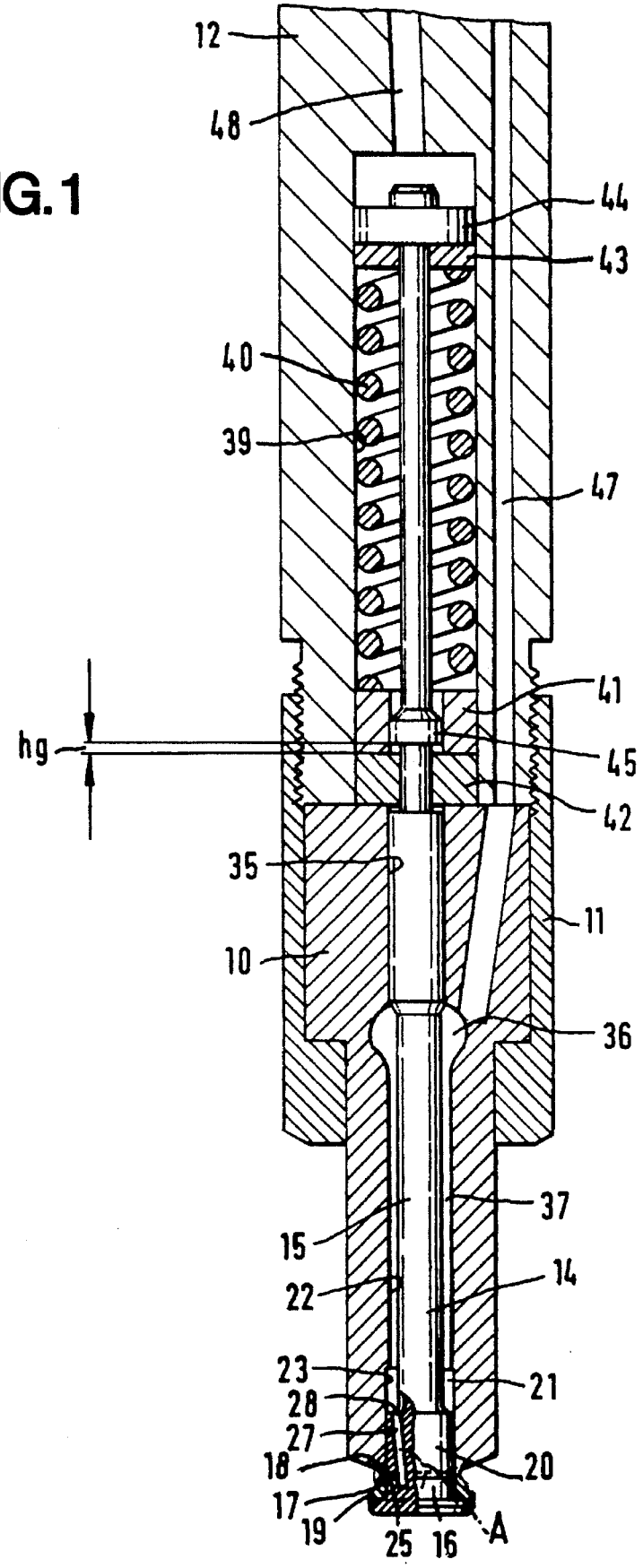
FIG. 1 shows a longitudinal section through a fuel injection nozzle.

The fuel injection nozzle has a nozzle body 10, which by means of a union nut 11 is screwed tightly to a nozzle holder 12. In the nozzle body 10, a valve needle 15 is movably supported which on the combustion chamber end carries a closing head 16. A ring 19 is tightly screwed to an obtuse cone-shaped valve cone 17 on the combustion chamber end of the closing head 16, which ring works together with a hollow cone-shaped valve seat 18 on the nozzle body 10. The section of the closing head 16 which protrudes into the nozzle body 10, and which is offset radially opposite the valve cone 17, is embodied as a piston slide 20, which is guided in a guide section 23 of a cylinder bore 22 in the nozzle body 10 close to the valve seat 18, which guide section comprises a pressure chamber 21.

Preferably a plurality of injection ports 25 are disposed in the piston slide 20, of which only one is shown, whose discharge point is in the jacket of the piston slide 20 and is spaced apart only slightly if at all from the valve cone 17 so that, upon the opening stroke of the closing head 16, its injection cross section is continuously unblocked by the inner edge of the valve seat 18, which comprises a control edge 24. The longitudinal axis of the injection port 25 extends at a nearly right angle a with regard to the axis of the motion of the valve needle 15 and the longitudinal axis of the nozzle body 10. This angle a is adapted to the form of the combustion chamber of the engine. The length of the injection port 25 is within the range of two to five times its width.

The injection port 25 is supplied with fuel from the pressure chamber 21 by means of an inlet conduit 27 in the piston slide 20. This inlet conduit 27 is preferably embodied as a blind bore 27 and runs approximately parallel to the axis of the piston slide 20. Its intake 28 is disposed on the face end of the closing head 16 or of the piston slide 20, oriented toward the pressure chamber 21, next to the centrally disposed shank 14 of the valve needle 15. For the sake of the general plan, the closing head 16 of the above described exemplary embodiment of the fuel injection nozzle is shown only having a single injection port 25 and a single inlet conduit 27. Experience has shown, however, that as a rule fuel injection nozzles require a plurality of injection ports which are distributed regularly or irregularly about the circumference of the closing head 16 and also can have the same or differing injection angles.

The valve needle 15 is supported so that it can slide in a guide bore 35 in the nozzle body 10, which bore 35 on the downstream side is adjoined by a collecting chamber 36 and an annular gap, which connects this to the pressure chamber 21. In the rest position, the valve needle 15 is pulled by a closing spring 40, which is disposed in a spring chamber 39 in the nozzle holder 12, so that the valve cone 17 of its closing head 16 rests against the valve seat 18 on the nozzle body 10. The closing spring 40 is supported via a distance bush 41 and a slotted stop disk 42 on the nozzle body 10 and presses via a compensating disk 43 against a support ring 44 fastened on the end of the valve needle 15. To define the entire stroke hg of the valve needle 15, at the level of the stop disk 42 the shank 14 of the valve needle 15 is offset forming a stop collar 45, which in the closed position of the valve needle 15 has the distance hg from the stop disk 42. An inlet conduit 47 in the nozzle holder 12 and in the nozzle body 10 leads to the collecting chamber 36 in the nozzle body 10. Furthermore an overflow oil conduit 48 leads from the spring chamber 39.

In a known injection nozzle, as shown in FIG. 2, an injection port 25 having a, for example, rectangular cross section is built into the piston slide 20 to form an injection stream; the longitudinal axis of the injection port 25 is oblique with regard to the center axis or axis of reciprocation of the piston slide 20 at an angle adapted to the combustion chamber. In the closed position, the discharge point of the injection port is covered by the wall of the nozzle body 10, and in the opening position it is cleared by the control edge 24 on the inner edge of the valve seat 18 of the nozzle body 10 as a result of the axial motion of the valve needle 15 and of the piston slide 20, dependent upon the stroke of the piston slide 20. Upon full unblocking of the discharge point cross section of the injection port 25, that is when during full engine load, the fuel is supplied at high pressure, fuel flows out of the injection port 25 as a directed injection stream; the axis of the injection stream is aligned with the axis of the injection port 25. At a partially open position of the injection port 25, as shown in FIGS. 2*a* and 2*b*, when to inject a partial quantity the wall of the nozzle body 10 partially covers the discharge point cross section of the injection port 25 up to the control edge 24, the outgoing injection stream, that is shown for example by flow line c, is deflected by the control edge 24 away from the axis of the injection port 25 so that the downstream angle b is less than the axis angle a of the injection port 25, which at the same time is the ideal injection angle of the injection stream for an optimal combustion.

One such ideal alignment of the injection stream at a partially open position of the injection port 25 could be attainable if, as shown in FIGS. 3*a* and 3*b*, a plurality of extremely thin guide partitions 51 or baffles were disposed in the injection port parallel to its axis. In each position of the injection port 25, these guide partitions would hinder the deflection effect of the control edge 24 on the nozzle body 10, as is shown by the flow line d, whose axis corresponds to the alignment of the axis of the injection and of the guide partitions 51 so that the injection angle b' is the same as the aligning angle or axis angle a of the injection port 25. Since such an ideal embodiment form can only be made at great cost, an embodiment form is suggested, which is shown in FIGS. 4*a* and 4*b*. According to this embodiment form, the injection port comprises two conduits 52, 53, which are disposed over one another parallel in the stroke direction of the piston slide 20 and separated from each other by a dividing wall 55. Both conduits 52, 53 are produced as cylindrical holes whose axes are sloped at the angle a from the axis of reciprocation of the piston slide 20. The conduits 52, 53 have as small a diameter or width as possible, and the dividing wall 55 is as thin as possible. The width of the conduits 52, 53 is for example from 0.100 to 0.200 mm, preferably 0.140 mm and the thickness of the dividing wall 55 is approximately half the width of the conduits 52, 53, preferably 0.070 mm.

For injecting fuel into the combustion chamber, the valve needle 15, having the closing head 16 and the piston slide 20 in the nozzle body 10, is axially moved and acted upon by the pressure of the supplied fuel. Next, the valve cone 17 lifts off from the valve seat 18 and then, or even at the same time, the injection cross section is unblocked as a function of the pressure of the fuel. This is achieved by means of one or both discharge point cross sections of the conduits 52, 53 being partially or fully moved above of the control edge 24. At the lowest partial load of the engine, the piston slide 20 is moved by approximately 40% of the entire stroke hg so that the lower conduit 52 is almost fully opened by the control edge 24. In this position the injection stream flowing out of this conduit undergoes only a slight deflection by means of the control edge 24 so that the ideal injection direction is nearly identical to the desired injection direction. At higher partial load, when the lower conduit 52 is completely unblocked, the ideal injection direction is achieved. At even higher partial load, when the upper conduit 53 is also unblocked by the control edge 24, the partial stream flowing out of the upper conduit 53 is deflected toward the partial stream f flowing out of the lower conduit 52 so that the two partial streams e and f unite with one another. When the discharge point cross section of the upper conduit 53 is only a little bit open, the stream direction energy of the partial stream e flowing out of the upper conduit 53 is slight compared to the lower partial stream f flowing out of a full cross section so that upon uniting to become a single stream g, hardly any deflection takes place. If the upper conduit 53 is opened even wider, for example halfway as shown in FIGS. 4*a* and 4*b*, the stream direction energy of the stream e flowing out of it is in fact greater, but the deflection is less still so that the stream generated is likewise deflected only slightly from the desired direction; its direction angle b" diverges only slightly from the ideal angle. Finally, the stream direction of the united injection stream g flowing out of both conduits 52, 53 comes closer and closer to the desired angle, the more the discharge point of the second conduit 53 is unblocked by the control edge 24. Measurements of an injection nozzle according to FIGS. 4*a* and 4*b*, have revealed that in the operating range of the injection nozzle, the greatest stream deflection diverges from the desired angle a by at most 2.5 degrees.

In addition it is noted that over the entire operating range of the internal combustion engine, the actual injection direction of the injection stream is all the more adapted to the desired direction, the more conduits are attached to an injection port or the more guide partitions an injection port has. In order to realize so many conduits in the injection nozzle, however, improved manufacturing processes are required for example micromechanics.

The foregoing relates to a preferred exemplary embodiment of the invention, it being understood that other variants and embodiments thereof are possible within the spirit and scope of the invention, the latter being defined by the appended claims.

WHAT IS CLAIMED AND DESIRED TO BE SECURED BY LETTERS PATENT OF THE UNITED STATES IS:

1. A fuel injection nozzle for internal combustion engines of an outwardly-opening construction comprising a nozzle body, a bore in said nozzle body, a valve member which is moved by fuel pressure acting against a tension of a closing spring, said valve member has a closing head which is directed at a set angle relative to an axis of reciprocation of the valve member, at least one injection port is disposed in said closing head whose discharge point cross section, in the closed position of the valve member, is closed by the nozzle body and upon an opening stroke is continuously opened by a control edge on a combustion chamber end of the nozzle body, a first angle is formed between a longitudinal axis of said at least one injection port and said axis of reciprocation of the valve member, the at least one injection port (25) is divided by at least one thin dividing wall (55) into a plurality of parallel flow conduits (52, 53) whose discharge points on the opening stroke of the valve member (16, 20) are unblocked one after the other, wherein the unblocked partial flows (e, f) unite into one injection stream (g) whose axis forms with said axis of reciprocation of the valve member a second angle which is substantially equal to said first angle.

2. The fuel injection nozzle according to claim 1, in which said plurality of parallel flow conduits comprise at least two conduits (52, 53) disposed over one another parallel in the direction the axis of reciprocation of the valve member and in that the thickness of the at least one thin dividing wall (55) is half the width of a conduit.

3. The fuel injection nozzle according to claim 2, in which the width of the at least two conduits (52, 53) is between 0.100 and 0.200 mm, and the thickness of the at least one dividing wall (55) is between 0.050 and 0.100 mm.

4. The fuel injection nozzle according to claim 3, in which the at least two conduits (52, 53) have the same cross sections.

5. The fuel injection nozzle according to claim 4, in which the at least two conduits (52, 53) have a circular cross section.

6. The fuel injection nozzle according to claim 3, in which the at least two conduits (52, 53) have a circular cross section.

7. The fuel injection nozzle according to claim 2, in which the at least two conduits (52, 53) have a circular cross section.

* * * * *